US011572680B1

(12) United States Patent
Turocy

(10) Patent No.: US 11,572,680 B1
(45) Date of Patent: Feb. 7, 2023

(54) URINE DEFLECTOR

(71) Applicant: Nathan R. Turocy, Chesterland, OH (US)

(72) Inventor: Nathan R. Turocy, Chesterland, OH (US)

(73) Assignee: Nathan R. Turocy

( * ) Notice: Subject to any disclaimer, the term of this patent is extended or adjusted under 35 U.S.C. 154(b) by 0 days.

(21) Appl. No.: 17/529,489

(22) Filed: Nov. 18, 2021

(51) Int. Cl.

| | |
|---|---|
| ***E03D 9/00*** | (2006.01) |
| ***A47K 13/24*** | (2006.01) |
| ***E03D 11/13*** | (2006.01) |
| ***E03D 13/00*** | (2006.01) |

(52) U.S. Cl.
CPC ..... *E03D 9/00* (2013.01); *A47K 13/24* (2013.01); *E03D 11/13* (2013.01); *E03D 13/005* (2013.01)

(58) Field of Classification Search
CPC ..... E03D 9/00; A47K 13/24
USPC ..... 4/300.3
See application file for complete search history.

(56) References Cited

U.S. PATENT DOCUMENTS

| | | | | |
|---|---|---|---|---|
| D405,168 | S | 2/1999 | Henry | |
| 7,178,177 | B1 * | 2/2007 | Valencia | E03D 9/00 4/300.3 |
| 7,461,413 | B2 | 12/2008 | Lewis et al. | |
| 8,266,731 | B2 * | 9/2012 | Marra | A47K 13/08 4/300.3 |
| 2005/0198727 | A1 | 9/2005 | Conn et al. | |
| 2007/0056086 | A1 * | 3/2007 | Raviendran | E03D 9/00 4/300.3 |
| 2015/0330066 | A1 | 11/2015 | Marra | |

* cited by examiner

*Primary Examiner* — Janie M Loeppke
(74) *Attorney, Agent, or Firm* — Amin, Turocy & Watson, LLP

(57) ABSTRACT

A urine deflector is configured to attach to a toilet seat and is made of a monolithic structure comprising an arcuate top member having a planar top surface integrally formed with an arc shaped projecting portion, the arc shaped projecting portion projecting downwardly from the top member, the projecting portion integrally formed, at each end of the arc shape, with a gravity assist drain portion, each gravity assist drain portion extending from the projecting portion at an angle from 30° to 60° from a plane defined by a top surface of the top member that facilitates directing urine liquid into a toilet bowl when the toilet seat is in either a seated position or an open position.

20 Claims, 2 Drawing Sheets

URINE DEFLECTOR

TECHNICAL FIELD

Disclosed are urine deflectors, methods of keeping a toilet area clean, and a toilet with a urine deflector.

BACKGROUND

Cleaning a bathroom, and specifically cleaning a western toilet, is a disfavored activity. Such cleaning involves exposure to foul smelling urine, germs that feed off of the urine, and corrosive and/or irritating disinfectants and/or cleaners. It is known to provide disks or cartridges that time-release detergents or disinfectants into the water stream of the tank. However, because the rim and exterior of the toilet bowl are not rinsed with each flush of the toilet, the rim and exterior become the dirtiest part of the toilet. Regular cleaning is needed to avoid the accumulation of stains and/or odors.

The sources of contamination to the exterior and rim of the toilet bowl are well known. For example, when men urinate from the standing position, misdirected and splashed urine builds up on the rim. To maximize urine containment within the bowl, men may elect to urinate from the sitting position. However, if the man does not properly direct his urine stream, urine can splash, squirt, or leak between the toilet bowl and the seat, thereby contaminating the rim and bowl exterior (if urine drips down from the rim). This occurs more frequently with young boys who have no objective to contain a urine stream within the toilet bowl. Such urine misdirection can also occur in a woman's urine stream.

SUMMARY

The following presents a simplified summary of the invention in order to provide a basic understanding of some aspects of the invention. This summary is not an extensive overview of the invention. It is intended to neither identify key or critical elements of the invention nor delineate the scope of the invention. Rather, the sole purpose of this summary is to present some concepts of the invention in a simplified form as a prelude to the more detailed description that is presented hereinafter.

One aspect of the invention relates to urine deflector configured to attach to a toilet seat, containing a monolithic structure of an arcuate top member having a planar top surface integrally formed with an arc shaped projecting portion, the arc shaped projecting portion projecting downwardly from the top member, the projecting portion integrally formed, at each end of the arc shape, with a gravity assist drain portion, each gravity assist drain portion extending from 0.5 inches to 6 inches from the projecting portion at an angle from 30° to 60° from a plane defined by a top surface of the top member that facilitates directing urine liquid into a toilet bowl when the toilet seat is in either a seated position or an open position.

Another aspect of the invention relates to a urine deflector configured to attach to a toilet seat, containing a monolithic polymeric material comprising an arcuate top member having a planar top surface integrally formed with an arc shaped projecting portion, the arc shaped projecting portion projecting downwardly from the top member, the projecting portion integrally formed, at each end of the arc shape, with a gravity assist drain portion, each gravity assist drain portion extending from 1 inch to 4 inches from the projecting portion at an angle from 40° to 50° from a plane defined by a top surface of the top member that facilitates directing urine liquid into a toilet bowl when the toilet seat is in either a seated position or an open position, wherein arc shaped projecting portion encompassing from one third to two thirds of a circumference of the toilet seat.

Yet another aspect of the invention relates to a method of preventing urine spills around a toilet involving attaching a urine deflector as described herein including gravity assist drain portions to a toilet seat.

To the accomplishment of the foregoing and related ends, the invention comprises the features hereinafter fully described and particularly pointed out in the claims. The following description and the annexed drawings set forth in detail certain illustrative aspects and implementations of the invention. These are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION

Described herein is a urine deflector that conveniently directs urine projected from a person urinating while sitting on a toilet seat, that might escape a toilet through an air gap between the toilet seat and the toilet bowl.

Figure 1:
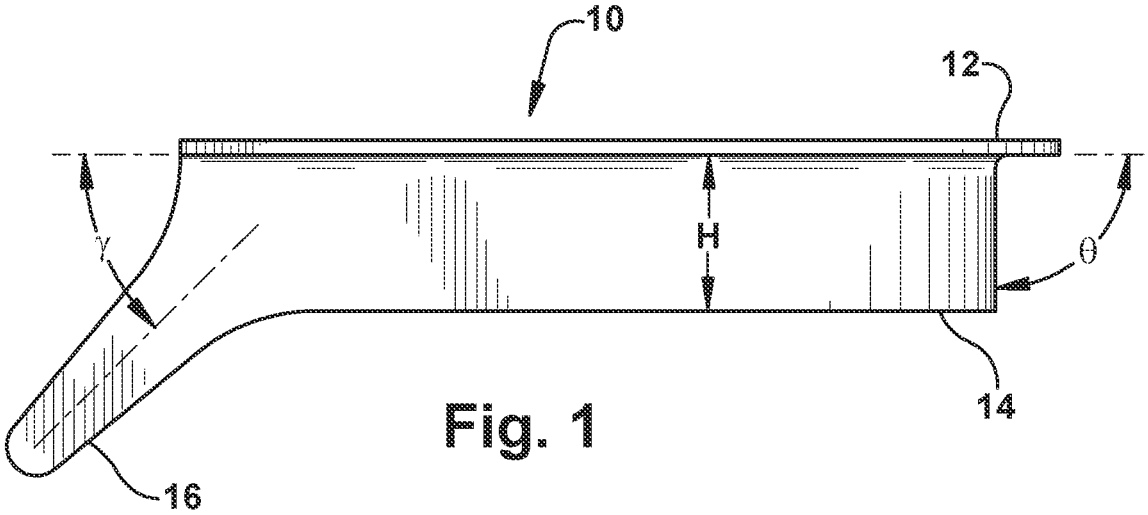
FIG. 1 is a left side view of a urine deflector in accordance with an embodiment.
Figure 2:
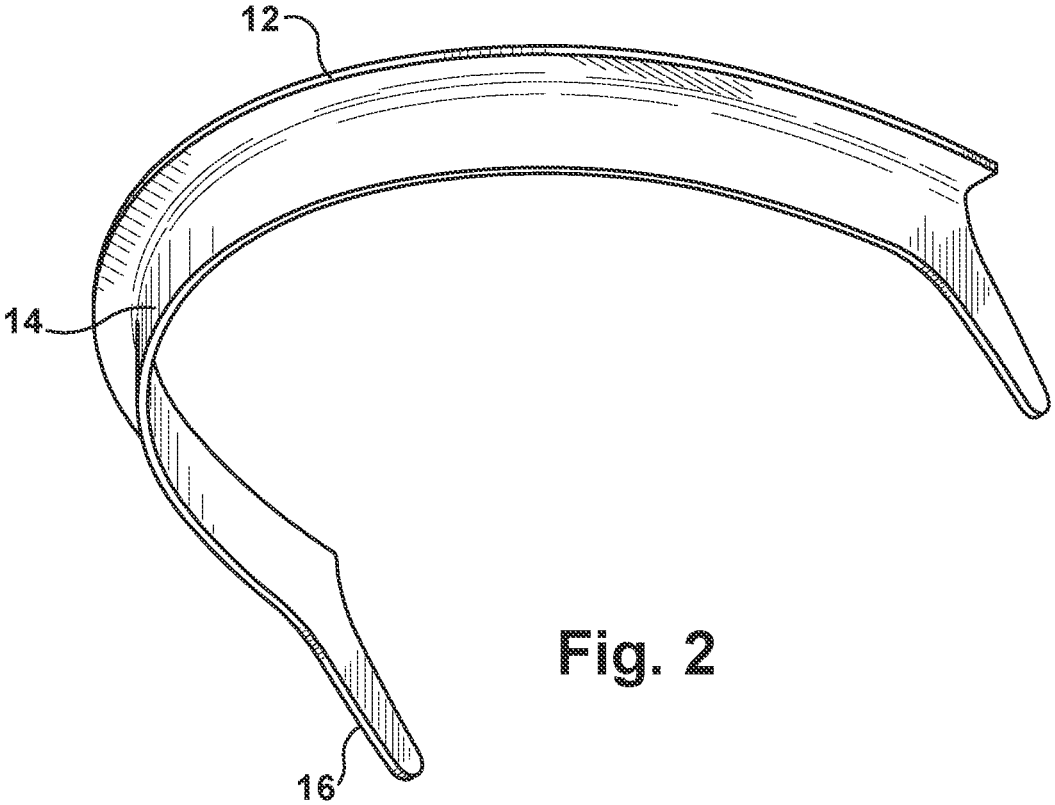
FIG. 2 is a bottom perspective view of a urine deflector in accordance with an embodiment.
Figure 3:
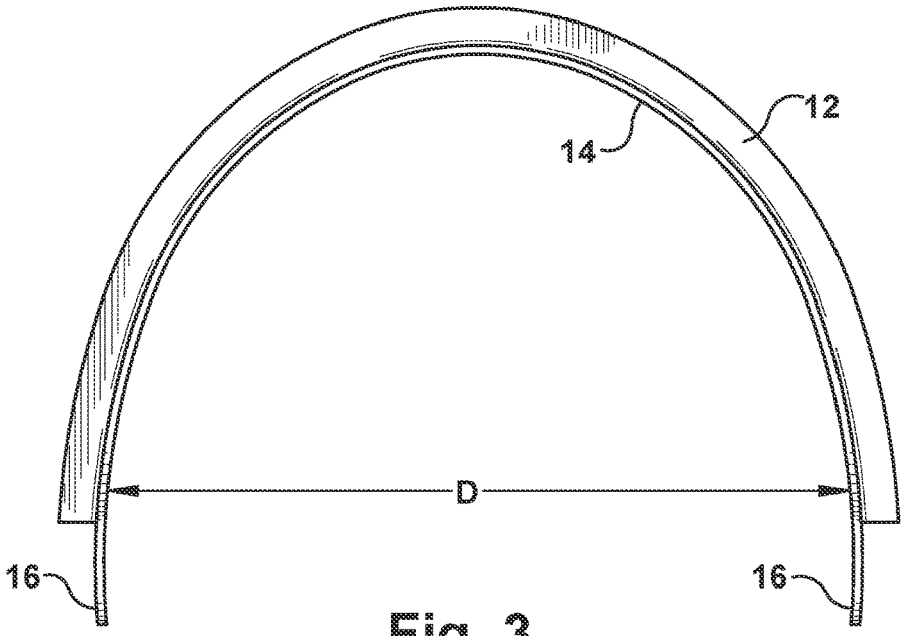
FIG. 3 is a bottom view of a urine deflector in accordance with an embodiment.

As shown in FIGS. 1, 2, and 3, wherein like numerals indicate like elements throughout, the urine deflector 10 comprises an arcuate top member 12 which can have an adhesive layer and liner (not shown) to facilitate attachment to a toilet seat (not yet shown). As shown in FIGS. 1, 2, and 3, the top member 12 includes a generally curved, planar top portion integrally formed with a generally arcuate projecting portion 14 (sharing the same or substantially the same arc measurements), projecting downwardly from the top member 12, the projecting portion 14 integrally formed, at the two ends of the arch, with two gravity assist drain portions 16, respectively.

Figure 4:
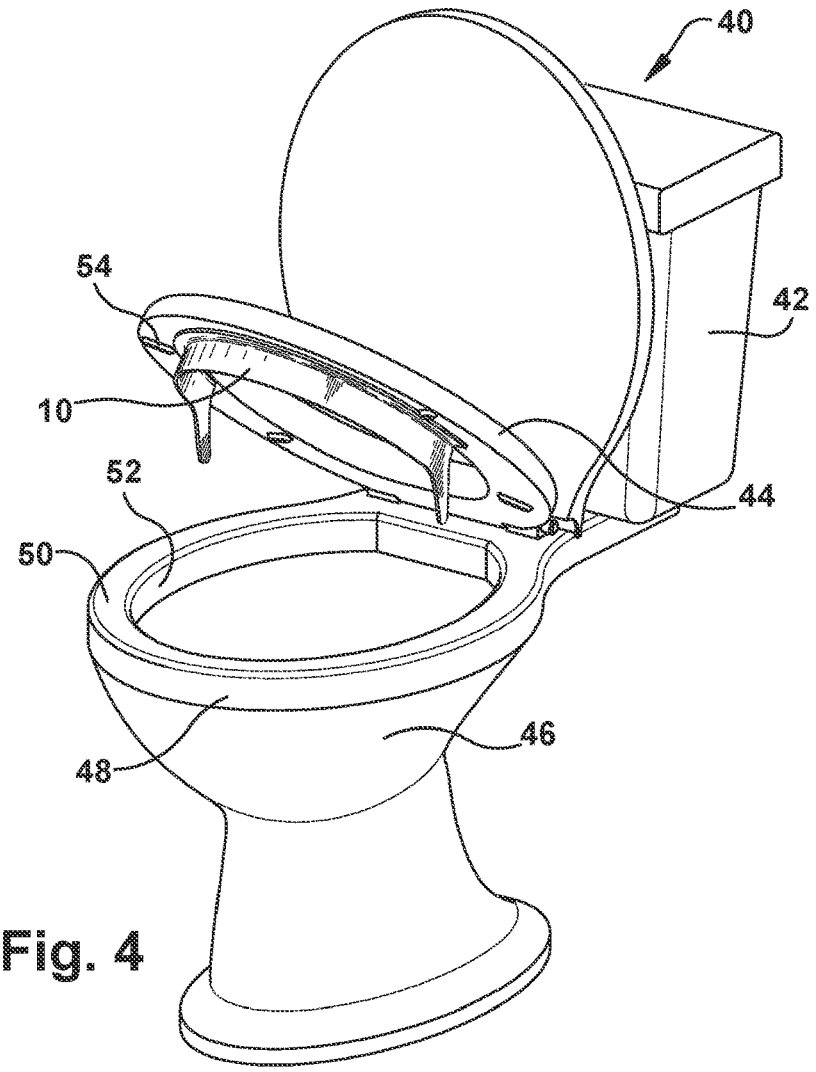
FIG. 4 is a perspective view of a urine deflector installed on a toilet seat on a toilet in accordance with an embodiment.

The top member 12 defines a curvature at least partially complementary to the curvature along a generally central front portion of the toilet seat 44, as shown in FIG. 4. The arcuate projecting portion 14 defines a curvature complementary to the curvature along a generally central portion of the inside surface 52 of the upper rim 48 of the toilet 40. The guard member 12 defines an arc length adapted to span at least a generally central front portion of the rim 48 and the toilet seat 44.

The specific arc shape is not critical so long as the top member 12 and the projecting portion 14 share the same or substantially the same arc measurements. Examples of arc shapes include a perfect arc, a palladium arc, and eyebrow arc, an elongated arc, a non-perfect arc, a semi-circular arc, an elliptical arc, a horseshoe arc, a segmental arc, and the like. By the same or substantially the same arc measurements, it is mean that at the intersection of the top member 12 and the projecting portion 14, the arc length is the same or substantially the same, and/or the height/width are the same or substantially the same.

For example, the top member 12 may define an arc length of about a semi-circle (or semi-oval) corresponding generally to the front half of the inside surface 52 of the upper rim 48 of the toilet 40. However, as is understood by those of ordinary skill in the art, the top member 12 may define an arc length less than half, such as about one third of a semi-circle (or semi-oval) corresponding generally to the front third of the inside surface 52 of the upper rim 48 of the toilet 40. The top member 12 may define an arc length greater than half, such as about two thirds of a semi-circle (or semi-oval) corresponding generally to the front two thirds of the inside surface 52 of the upper rim 48 of the toilet 40.

In one embodiment, the length of the top member 12 (generally the arc length) is from 5 inches to 25 inches. In another embodiment, the length of the top member is from 6 inches to 20 inches. In yet another embodiment, the length of the top member is from 8 inches to 15 inches.

The depth H of the projecting portion 14 (see FIG. 1) is large enough to extend vertically at least slightly below the upper surface 50 of the rim 48 when the urine deflector 10 is assembled to the underside of the toilet seat 44 and the toilet seat 44 is in the seated position, thereby covering the air gap between the toilet seat 44 and the rim 48, enabling urine deflection.

H can be constant along the length of the projecting portion 14 or H may vary along the length. In one embodiment, the projecting portion 14 also defines a generally equal depth along the curved length thereof, except for the gravity assist members 16. In another embodiment, the projecting portion 14 of the urine deflector 10 has a minimum depth at the front of the toilet bowl, and tapering lower to have a maximum depth near the gravity assist drain portions 16. Such tapered (increasing to the ends of the arcs) facilitates movement or draining of urine from the projecting portion 14 to the gravity assist members 16, and then into the toilet bowl.

The urine deflector 10 has two gravity assist drain portions 16 at each end of the arc length. The gravity assist drain portions 16 facilitate directing urine liquid that may adhere to or be directed by the urine deflector 10 into the toilet bowl. The gravity assist drain portions 16 facilitate the movement of urine liquid that has collected on the urine deflector 10 to drain into the bowl instead of pooling at the bottom of the urine deflector 10 (that is bottom of the projecting portion 14), dripping onto the toilet bowl rim, or dripping onto the hinges. The gravity assist drain portions 16 facilitate such benefits in both situations of the toilet seat 44 in the seated position and the toilet seat 44 in the open position (toilet seat vertically aligned perpendicular to the floor).

Referring to again FIG. 1, the gravity assist drain portions 16 are shown projecting from the plane defined by the top planar surface of the top member 12 at a 45° angle. That is, in one embodiment, $\gamma$ is 45°. The specific benefit of a 45° angle is that the gravity assist drain portions 16 remain at 45° relative to the upper surface 50 of the rim 48 (see FIG. 4) whether the toilet seat is in the seated position or the open position. However, the gravity assist drain portions 16 can project from the plane defined by the top member 12 at any angle that facilitates directing urine liquid into the toilet bowl when the toilet seat is in both the seated position and the open position. In another embodiment, for example, $\gamma$ is from 30° to 60°. In yet another embodiment, $\gamma$ is from 40° to 50°.

The length of the gravity assist drain portions 16 is sufficient so that the ends of the gravity assist drain portions 16 are over the inside of the rim 48 of the toilet bowl 46. In this manner, urine dripping from the gravity assist drain portions 16 conveniently falls into the toilet bowl 46 thereby avoiding urine spillage onto the outside of the toilet bowl 46 or onto the floor surrounding the toilet 40. In one embodiment, the length of the gravity assist drain portions 16 (as measured from the bottom—underneath surface of the projecting portion 14 to the end of the gravity assist drain portions 16) is from 0.5 inches to 6 inches. In another embodiment, the length of the gravity assist drain portions is from 1 inch to 4 inches. In yet another embodiment, the length of the gravity assist drain portions is from 2 inches to 3 inches. The gravity assist drain portions 16 have a length sufficient so that the ends of the gravity assist drain portions 16 are over the inside of the rim 48 of the toilet bowl 46 whether the toilet seat 44 is in the open or closed position.

As shown in FIG. 1, the projecting portion 14 defines substantially perpendicular or a perpendicular angle (8) with the plane defined by the top planar surface of the top member 12. In this manner, the projecting portion 14 and the top member 12 together have an upside down "L" shape. However, as is understood, the projecting member 14 may alternatively project substantially perpendicularly downwardly from the top member 12 or define a slightly acute or obtuse angle relative thereto.

In the urine deflector 10 including the top member 12, the projecting portion 14, and the gravity assist drain portions 16 are a monolithic, unitary structure. The urine deflector 10 can be made by molding a polymeric material, such as, for example, a thermoplastic or thermoset polymer such as a polyolefin such as polypropylene or polyethylene, a polystyrene, a polyvinyl chloride, a polycarbonate, an acrylonitrile butadiene styrene, or a polyester. The urine deflector 10 can also include a biocide or antimicrobial agent. Examples of commonly used biocides and antimicrobial agent are: 1,2-benzisothiazolin-3-one ("BIT"), and a blend of 5-chloro-2-methyl-4-isothiazolin-3-one ("CIT"), 2-methyl-4-isothiazolin-3-one ("MIT"), 1,2-dibromo-2,4-dicyanobutane ("DBDCB"), 2,2-dibromo-3-nitrilopropionamide ("DBNPA"), 2-bromo-2-nitro-1,3-propanediol ("BNPD"), aldehyde derivatives, formaldehyde releasing agents, hydantoins, chlorinated aromatics, 2-(thiocyanomethylthio)benzothiazole (sold as BUSAN®), MICROBAN® (U.S. Pat. No. 6,767,647), and salt of pyrithione (U.S. Pat. No. 6,893,752). MICROBAN® antimicrobial plastic additives can be integrated into any of the thermoplastic and thermoset polymers. Metal containing compositions of salts or complexes of silver, copper or zinc can alternatively be added to obtain antimicrobial properties. The urine deflector 10 can be made of a metal or metal alloy, optionally treated with or made with antimicrobial materials.

The urine deflector 10 may additionally be fragranced or scented. In one embodiment, the polymeric material utilized to construct the urine deflector 10 is mixed with fragrance infused plastic pellets prior to forming, e.g., molding, the urine deflector 10. The fragrance infused plastic pellets, such as, for example, pellets infused with a fresh linen smell, comprise approximately 2% of the material utilized to form the urine deflector 10.

The adhesive layer can include a liner layer (not shown) along the free side thereof, prior to installation, having a pull tab for easy removal just prior to attachment to a toilet seat. The urine deflector 10 can be permanently attached to the toilet seat, or removably/temporarily attached to the toilet seat.

Referring to the drawings in more detail, referring to FIG. 4, a urine deflector 10 is shown optionally removably attachable (or permanently attached) to an underside of a toilet seat 44 of a western toilet 40. A western toilet 50 typically includes a tank 42, supported by an elongate bowl 46 having a generally oval shaped upper rim 48. It is to be understood that the urine deflector 10 can be usable with a western toilet or some other toilet having a rounded bowl or other curvature, without departing from the scope herein. That is, while the toilet seat 44 is shown installed on a toilet having an elongate bowl, it is appreciated that the toilet seat 44 can be used with a toilet having a round bowl, an egg-shaped bowl, an oval bowl, an elliptical bowl, without departing from the scope of the invention.

The rim 48 defines a generally flat upper surface 50 and an inside surface 52. The toilet 40 further includes a toilet seat 44, having a generally oval shape (or circular or deformed oval), complimenting the generally oval shape (or whatever the specific shape) of the rim 48. The toilet seat 44 is pivotably attached to the bowl 46, such as, for example, via a pair of hinges, and movable between an upright position and a down or seated position. The toilet seat 44 includes at least a pair of lugs 54 fixed to, and projecting downwardly from, an underside of the seat 44. The lugs 54 elevate the toilet seat 44 relative to the upper surface 50 of the rim 48, i.e., the top surface of the bowl 46, when the seat 44 is in the seated position, forming an air gap between the seat 44 and the rim 48 whereby the seat 44 and the rim 48 do not contact each other.

The toilet seat 44 is an endless form that has a shape that compliments the shape of the rim 48 of the bowl 46. The seat 44 has a top surface to support a human, a bottom surface to which a pair or more of lugs 54 can be fixed to, a front section away from the tank 42, a back section near the tank and hinges, opposed side sections (left and right), an outer periphery, and an inner periphery. The diameter of the inner periphery of the toilet seat 44 is less than the inside surface 52 of the rim 48.

Mounting the urine deflector 10 to a toilet seat 44 involves determining a proper position for the urine deflector 10 so that the toilet seat closes without interruption. The top member 12 is placed against the underside of the toilet seat 44 in an estimated proper position, i.e., along the inner circumference of the underside of the toilet seat 44, behind the lugs 54 if necessary, along a generally central front portion thereof. Thereafter, when the toilet seat 44 is completely lowered into the seated position, the top member 12 does not contact the toilet bowl 46. With the toilet seat 44 in the seated position, the top member 12 is positioned just inside the toilet bowl 46, blocking the gap between the toilet seat 44 and the rim 48. That is, the depth (H in FIG. 1) of the arcuate projecting portion 14 is great enough to extend vertically at least slightly below the upper surface 50 of the rim 48.

A liner layer covering an adhesive layer can be removed therefrom and the top member 12 is adhesively attached to the underside of the toilet seat 44. That is, the urine deflector 10 can further include an adhesive layer on the top surface of the top member 12 to facilitate attachment of the urine deflector 10 to a toilet seat 44 by a user. Prior to attachment and/or use of the urine deflector 10, a releasable or peel away liner layer can cover the adhesive layer to prevent unnecessary sticking and/or facilitate easy transportation and handling of the urine deflector 10.

In use, the projecting member 14 covers at least the generally central portion of the gap between the toilet seat 44 and the rim 48, and is capable of deflecting urine that splashes or squirts thereon downwardly into the toilet bowl 46. Whenever the top member 12 is dirty or contaminated, e.g., by urine, a user can simply wash the urine deflector 10.

Referring to FIG. 3 in relation to FIG. 4, the inner diameter D (see FIG. 3) of the projecting portion 14 of the urine deflector 10 is less than the inner diameter of the inside surface 52 of the rim 48 so that a gap is formed between the urine deflector 10 and the inside surface 52 of the rim 48 so that the toilet seat 44 can be lifted upwardly and downwardly without the urine deflector 10 interfering with the rim 48.

To prevent urine from splashing, squirting, or otherwise leaking through the gap between the toilet seat 44 and the rim 48, the urine deflector 10 is fixed or attached to the bottom surface of the toilet seat 44. The urine deflector 10 extends downwardly (substantially perpendicular to the bottom surface of the toilet seat 44) blocking the gap between the toilet seat 44 and the rim 48 and thereby preventing or at least reducing the amount of urine that would escape the toilet bowl 46 but for the urine deflector 10.

When a human using the toilet 40 is in a sitting position (as opposed to a standing position in front of the toilet 40), the concern is that urine most likely will splash, squirt or leak toward the front of the toilet bowl 46. In one embodiment, the projecting portion 14 of the urine deflector 10 has a minimum depth to at least the upper surface 50 of the rim 48 (thereby blocking the gap between the toilet seat 44 and the rim 48). In another embodiment, the projecting portion 14 of the urine deflector 10 has a depth to greater than the upper surface 50 of the rim 48. In this embodiment, the projecting portion 14 of the urine deflector 10 protrudes generally vertically downward parallel to the inside surface 52 of the rim 48. Use of the urine deflector therefore involves methods of preventing and/or reducing urine spills when a person is urinating in a toilet. Use of the urine deflector also involves methods of maintaining the cleanliness of a restroom containing a toilet equipped with the urine deflector.

The following examples illustrate the subject invention. Unless otherwise indicated in the following examples and elsewhere in the specification and claims, all parts and percentages are by weight, all temperatures are in degrees Centigrade, and pressure is at or near atmospheric pressure.

It should also be understood that the terms "about," "approximately," "substantially" and like terms, used herein when referring to a dimension, angle, measurement, amount, or characteristic of a component, indicate that the described dimension/characteristic is not a strict boundary or parameter and does not exclude minor variations therefrom that are functionally similar. At a minimum, such references that include a numerical parameter include variations that, using mathematical and industrial principles accepted in the art (e.g., rounding, measurement or other systematic errors, manufacturing tolerances, etc.), do not vary the least significant digit.

With respect to any figure or numerical range for a given characteristic, a figure or a parameter from one range may be combined with another figure or a parameter from a different range for the same characteristic to generate a numerical range.

Other than in the operating examples, if any, or where otherwise indicated, all numbers, values and/or expressions referring to parameters, angles, quantities of ingredients, measurements, conditions, etc., used in the specification and claims are to be understood as modified in all instances by the term "about."

While the invention is explained in relation to certain embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A urine deflector configured to attach to a toilet seat, comprising:

a monolithic structure comprising an arcuate top member having a planar top surface integrally formed with an arc shaped projecting portion, the arc shaped projecting portion projecting downwardly from the top member, the projecting portion integrally formed, at each end of the arc shape, with a gravity assist drain portion, each gravity assist drain portion extending from 0.5 inches to 6 inches from the projecting portion at an angle from 30° to 60° from a plane defined by a top surface of the top member that facilitates directing urine liquid into a toilet bowl when the toilet seat is in either a seated position or an open position.

2. The urine deflector according to claim 1, each gravity assist drain portion extends from the projecting portion at an angle from 40° to 50° from a plane defined by the top surface of the top member.

3. The urine deflector according to claim 1, each gravity assist drain portion extends from the projecting portion at an angle of 45° from a plane defined by the top surface of the top member.

4. The urine deflector according to claim 1, wherein a length of the top member is from 5 inches to 25 inches.

5. The urine deflector according to claim 1, wherein the monolithic structure is made of a polymeric material.

6. The urine deflector according to claim 5, wherein the polymeric material comprises an antimicrobial agent.

7. The urine deflector according to claim 1, wherein the monolithic structure is made of a metal or metal alloy.

8. The urine deflector according to claim 7, wherein the metal or metal alloy comprises an antimicrobial agent.

9. The urine deflector according to claim 1, wherein the projecting portion has an equal depth along a length thereof, except for the gravity assist members.

10. The urine deflector according to claim 1, wherein the projecting portion has a minimum depth at a front of the toilet seat, and a gradually increasing depth approaching the gravity assist members.

11. The urine deflector according to claim 1, further comprising an adhesive layer on the top surface of the top member to facilitate attachment to the toilet seat.

12. The urine deflector according to claim 11, further comprising a liner layer over the adhesive layer.

13. A urine deflector configured to attach to a toilet seat, comprising:

a monolithic polymeric material comprising an arcuate top member having a planar top surface integrally formed with an arc shaped projecting portion, the arc shaped projecting portion projecting downwardly from the top member, the projecting portion integrally formed, at each end of the arc shape, with a gravity assist drain portion, each gravity assist drain portion extending from 1 inch to 4 inches from the projecting portion at an angle from 40° to 50° from a plane defined by a top surface of the top member that facilitates directing urine liquid into a toilet bowl when the toilet seat is in either a seated position or an open position, wherein the arc shaped projecting portion encompassing from one third to two thirds of a circumference of the toilet seat.

14. The urine deflector according to claim 13, each gravity assist drain portion extends from the projecting portion at an angle of 45° from a plane defined by the top surface of the top member.

15. The urine deflector according to claim 13, wherein a length of the top member is from 6 inches to 20 inches.

16. A western toilet, comprising:

a tank;

a bowl having an oval shaped upper rim;

a toilet seat attached to rotate between an open and closed position; and a urine deflector attached to the toilet seat, the urine deflector comprising a monolithic structure comprising an arcuate top member having a planar top surface integrally formed with an arc shaped projecting portion, the arc shaped projecting portion projecting downwardly from the top member enough so that the projecting portion extends below the oval shaped upper rim of the bowl, the projecting portion integrally formed, at each end of the arc shape, with a gravity assist drain portion, each gravity assist drain portion extending from 0.5 inches to 6 inches from the projecting portion at an angle from 30° to 60° from a plane defined by a top surface of the top member that facilitates directing urine liquid into a toilet bowl when the toilet seat is in either a seated position or an open position, the projecting portion having an inner diameter less than an inner diameter of an inside surface of the oval shaped upper rim so that a gap is formed between the urine deflector and the inside surface of the oval shaped upper rim so that the toilet seat rotates between an open and closed position without the urine deflector contacting the bowl.

17. The western toilet according to claim 16, each gravity assist drain portion extends from the projecting portion at an angle from 40° to 50° from a plane defined by the top surface of the top member.

18. The western toilet according to claim 16, wherein a length of the top member is from 7 inches to 15 inches.

19. The western toilet according to claim 16, wherein each gravity assist drain portion extends from 1 inch to 4 inches from the projecting portion.

20. A method of preventing urine spills around a toilet, comprising:

attaching the urine deflector according to claim 1 to a toilet seat.

* * * * *